US007621333B2

(12) United States Patent
Marchal

(10) Patent No.: US 7,621,333 B2
(45) Date of Patent: Nov. 24, 2009

(54) PROCESS TO IMPROVE EXTRACTION OF CRUDE OIL AND INSTALLATION IMPLEMENTING SUCH PROCESS

(75) Inventor: Philippe Marchal, Vaucresson (FR)

(73) Assignee: Majus, London (GB)

( * ) Notice: Subject to any disclaimer, the term of this patent is extended or adjusted under 35 U.S.C. 154(b) by 176 days.

(21) Appl. No.: 11/348,242

(22) Filed: Feb. 7, 2006

(65) Prior Publication Data

US 2006/0175053 A1 Aug. 10, 2006

(30) Foreign Application Priority Data

Feb. 7, 2005 (FR) ..... 05 01188

(51) Int. Cl.
*E21B 36/00* (2006.01)

(52) U.S. Cl. ..... 166/303; 166/304; 166/57

(58) Field of Classification Search ..... 166/303, 166/304, 57, 62, 272.6
See application file for complete search history.

(56) References Cited

U.S. PATENT DOCUMENTS 3,397,745 A 8/1968 Owens et al.
3,557,871 A * 1/1971 Parker ..... 166/57
4,296,739 A * 10/1981 Bolding ..... 126/666
4,623,585 A * 11/1986 Linton et al. ..... 428/312.8
4,624,485 A 11/1986 McStravick et al.
4,688,637 A * 8/1987 Theis ..... 166/245
4,896,725 A * 1/1990 Parker et al. ..... 166/267
4,951,748 A * 8/1990 Gill et al. ..... 166/248
5,289,881 A * 3/1994 Schuh ..... 166/303
5,626,193 A 5/1997 Nzekwu et al.
2004/0200615 A1* 10/2004 Wilde ..... 166/250.15
2005/0103497 A1* 5/2005 Gondouin ..... 166/302

FOREIGN PATENT DOCUMENTS

DE 33 28 080 A1 2/1985

* cited by examiner

*Primary Examiner*—William P Neuder
(74) *Attorney, Agent, or Firm*—Oliff & Berridge, Plc

(57) ABSTRACT

A hydrocarbon extraction process enabling an acceleration in the production of the productive zone of the oil deposit of a well and an increase in the cumulated quantity of hydrocarbons, characterized by the fact that a hot fluid constituted of hydrocarbons is made to circulate so as to bring the productive zone locally to a higher temperature by conduction in order to fluidify the hydrocarbons imprisoned in an underground reservoir, by means of a thermally-insulated pipe, the hot fluid being mixed with the hydrocarbons extracted via a liner or drain in the productive zone such mixture thus formed being recovered at the surface by means of an pumping pipe.

41 Claims, 4 Drawing Sheets

PROCESS TO IMPROVE EXTRACTION OF CRUDE OIL AND INSTALLATION IMPLEMENTING SUCH PROCESS

BACKGROUND OF THE INVENTION

1. Field of the Invention

The technical scope of the present invention is that of devices to extract liquids from geological deposits, of the hydrocarbon type.

2. Description of the Related Art

It is known to date how to extract liquids from the ground, for example hydrocarbons, which lie in underground deposits that may be several kilometers deep. After drilling a hole from the surface to the deposit, where the liquid to be extracted lies, the hole is consolidated progressively throughout the drilling process with pipes of tapered diameter. These pipes as a whole constitute a casing. In the production zone, towards the buried end, this casing is pierced with a certain number of holes so as to enable the fluid to accede to the production pipe. This perforated part is termed liner or drain depending on its length. A pipe of constant diameter but smaller than that of the casing is introduced into the preceding casing so as to reach the bottom of the drill hole in order to pump the liquid to the surface. This pipe is thus an extraction pipe.

One problem frequently encountered is that of the low value of the absolute or total flow from the well. This flow is linked to several factors, but it is essentially the viscosity of the liquid being extracted which causes problems. This liquid is all the more viscous in that it is at low temperature. Depending on the composition of the liquids to be extracted, another problem may arise. In the case of a liquid containing fractions able to solidify, for example paraffins or asphaltenes, these fractions tend to solidify and this increasingly as the temperature drops. These fractions tend to precipitate and thus progressively block the orifices in the production zone in the casing and in the oil deposit itself near the casing.

It can thus be observed that the high viscosity and solid precipitations cause said flow to slow down, which increases production costs per volume unit and may cause the closure of a well.

It is known for the injection of heat into an oil well to facilitate the flow from the source rock through the liner or drain. The heat acts in two ways: it reduces the viscosity of the crude oil thereby facilitating its flow and it prevents the formation of precipitations, paraffins and asphaltenes, or even melts those which may have formed before the injection of heat.

To overcome this problem, several solutions have already been applied. Reference may be made to U.S. Pat. Nos. 2,757,738 and 4,344,485.

One solution consists in injecting pressurised water vapor via an extraction pipe. Several drawbacks are incurred. Given the substantial length of a well, which may be of several kilometers, it is difficult to guarantee that the vapor will arrive hot at the bottom of the well. Moreover, the use of the extraction pipe for this requires the total stoppage of production during this phase. This method thus presents the drawbacks of discontinuous production (known as Huff 'n' Puff).

The drawbacks to the use of water vapor are well known. Indeed, these devices use great quantities of energy, and need complicated installations for injection and supply which may prove difficult in cold dry countries. Moreover, the injection of water vapor into the reservoir leads to the recovery of an oil/water (condensed steam)/steam residue mixture which then requires a specific installation for the separation of the oil from the water.

Another solution consists in injecting a solvent of heavy fractions into the reservoir zone. One drawback to this is the necessity of providing logistics for this solvent: supply, storage, etc. Another drawback lies in the fact that the chemical action of the solvent only operates on certain fractions. However, the other methods acting by heat injection have a double effect. They act both on the precipitations and on the fluidity of the warmed liquid, thereby improving extractible flow and extraction efficiency.

Another solution by heat injection consists in positioning a heater at the bottom of the well. This heater is advantageously an electrical resistance. The difficulty in diffusing this thermal power causes very high temperatures. Thereafter problems arise from choice of materials, both for the resistance and for the end of the casing and/or the extraction pipe. Given its position at the bottom of the well, it is difficult to make such a resistance both reliable and easily maintainable. Lastly, for safety reasons, it is tricky to introduce great quantities of electrical energy to the well bottom.

SUMMARY OF THE INVENTION

The aim of the present invention is to provide a system to improve the productivity of a well and to increase the recoverable reserves by sending heat into the reservoir by conduction without the introduction of substantial energy, such method being simple to implement and overcoming the aforementioned drawbacks.

The invention thus relates to a hydrocarbon extraction process enabling an acceleration in the production of the productive zone of the oil deposit of a well and an increase in the cumulated quantity of hydrocarbons, characterized by the fact that a hot fluid constituted of hydrocarbons is made to circulate so as to bring the productive zone to a higher temperature by conduction in order to fluidify the hydrocarbons imprisoned in an underground reservoir, by means of a thermally-insulated pipe, the hot fluid being mixed with the hydrocarbons extracted via a liner or drain in the productive zone such mixture thus formed being recovered at the surface by means of an extraction pipe.

The production is such that the arrival of frigories via the hydrocarbons extracted from the reservoir is less than the quantity of heat diffused mostly by conduction in the reservoir and whose flow is maintained at less than 3 barrels per day and per linear meter of drain or liner.

The invention also relates to a hydrocarbon extraction installation using a bore hole linking the surface to an oil deposit, comprising a substantially cylindrical casing consolidating said bore hole and an extraction pipe or pumping pipe housed inside said casing, said casing being extended by a liner or drain, characterized in that it comprises a boiler to produce hot fluid constituted by hydrocarbons, thermally insulated pipe connecting the boiler to the deposit enabling hot fluid to circulate from the surface to the liner to obtain a mixture constituted by a hot fluid and hydrocarbons coming from the deposit, and a recovery unit for the fluid mixture by means of the extraction pipe.

This circulation enables the temperature potential at the bottom of the well to be increased and thus the diameter of the liner or drain to be artificially enlarged and thus the production and recoverable reserves to be increased.

According to one characteristic, the pipe is inserted in the space available between the casing and the extraction pipe.

According to one characteristic, the pipe is inserted in the extraction pipe.

According to yet another characteristic, the hot fluid is a dissolvent for paraffins and/or asphaltenes or a fluidizer for hydrocarbons or a mixture of dissolvent/hydrocarbons.

According to yet another characteristic, the hot fluid is the mixture of extracted and heated fluid.

According to yet another characteristic, the pipe is constituted by a first inner pipe surrounded by a second external concentric pipe and an insulator housed in the space between the two pipes.

According to yet another characteristic, the insulator is a pulverulent material and a reduced pressure is established in the space between the two pipes.

According to yet another characteristic, the insulator is constituted of a reflective sheet onto which a powder has been deposited, said reflective sheet being wound around itself in a spiral.

According to yet another characteristic, said powder has a granulometry substantially equal to 40 μm, pores whose size is around that of the mean free path of the gas in which it is placed and a density of between 50 and 150 kg/m$^3$.

Advantageously, a pressure of between $10^{-2}$ and 1 mbar is maintained between the pipe's two pipes.

According to yet another characteristic, the pipe comprises spacers between the two pipes constituted of a compressed microporous material placed at regular intervals along the pipe and providing reinforcement preventing the insulator from being crushed.

According to yet another characteristic, the fluid is heated in the pipe using an electrical conductor.

One advantage of the device according to the invention lies in the injection of heat to the bottom of the well thus acting both on the paraffins and the asphaltenes which it melts and on the liquid, which it heats both at the bottom of the well and in close proximity to the end of the casing so as to fluidify it to improve the extraction flow, whilst ensuring production continuity.

Another advantage of the device according to the invention lies in that it may be implemented without requiring the stoppage of production during its use.

Another advantage of the device according to the invention is related to the reuse of the liquid extracted which obviates the necessity for heavy logistics linked to the use of an exogenous product.

Another advantage of the device according to the invention linked to the reuse of the extracted liquid lies in that it does not pollute the deposit.

Yet another advantage of the invention lies in the possibility of being able to melt the paraffins and asphaltenes so as to unblock both the pores in the production zone and the orifices in the liner or drain.

BRIEF DESCRIPTION OF THE DRAWINGS

Other characteristics, particulars and advantages of the invention will become more apparent from the detailed description given hereafter by way of example and in reference to the appended drawings, in which.

DETAILED DESCRIPTION OF PREFERRED EMBODIMENTS

Figure 1:
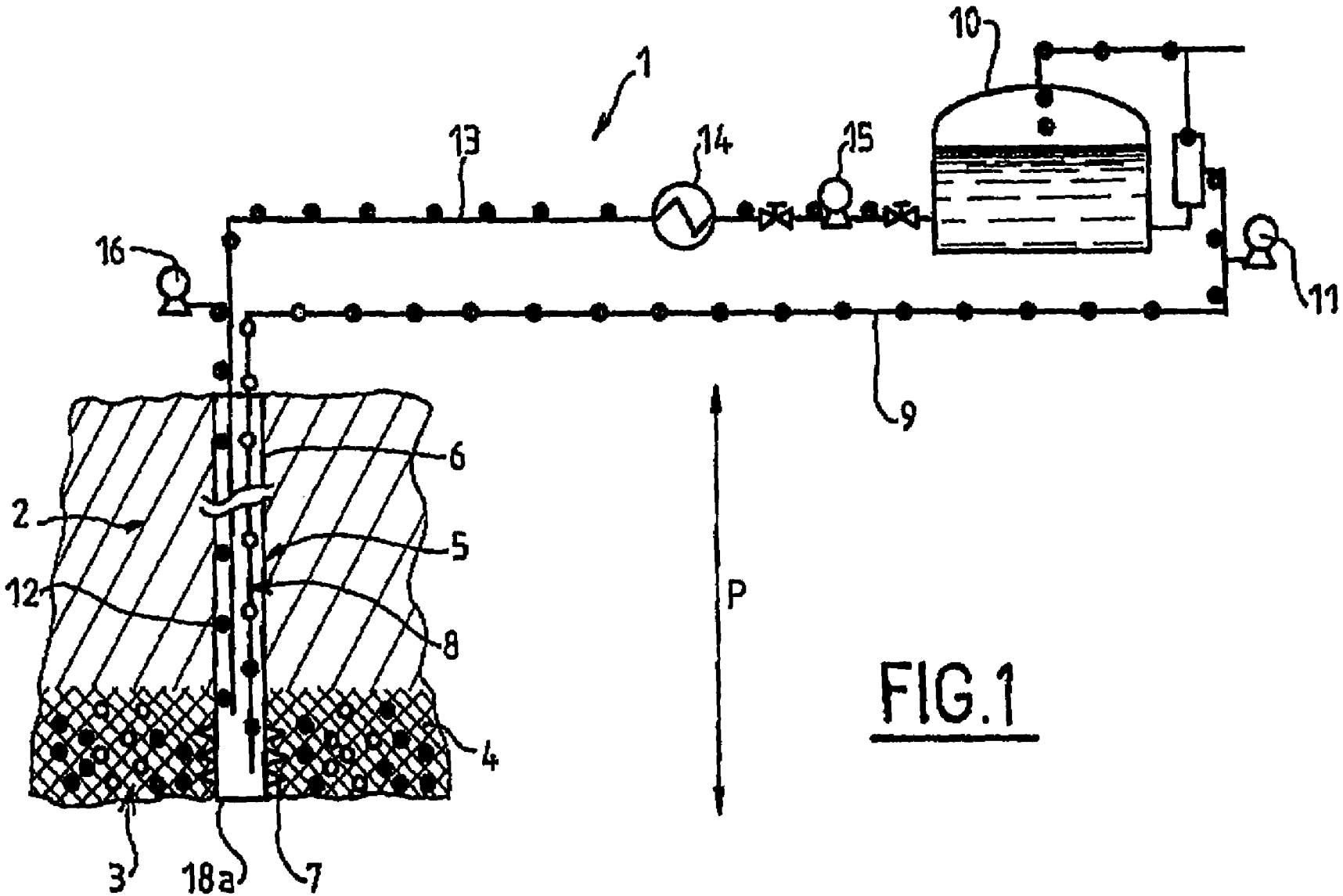
FIG. 1 illustrates an embodiment of an installation according to the invention.

An oil well is more generally constituted of two essential parts, an external pipe (called casing) intended to consolidate the external wall of the well in the ground and an inner pipe (called tubing) enabling the oil to be brought to the surface. A liner or drain fulfils two functions: it ensures the filtration of the extracted crude oil which rises to the surface and it prevents the bore hole from collapsing in the production zone. Different manual and automatic vanes provide sealing and safety from the well with respect to the exterior.

As mentioned previously, the aim of the invention is to provide heating to the production zone essentially by conduction and the quantity of energy diffused by conduction in the reservoir must be ensured to be sufficiently consequent to counterbalance the arrival of frigories from the produced hydrocarbons. It is estimated that the order of magnitude of hydrocarbon production must be 3 barrels less per day and per meter of liner or drain from the injection of heat to the efficient.

The thermal conduction of a reservoir rock is of between 0.7 and 3 W/m. °C. For the heat to be able to flow from the liner or drain into the reservoir rock, the crude flow must be 3 barrels less per day and per meter of liner or drain. This flow is low and so as to give an order of magnitude, a well whose liner or drain length is 10 meters must produce 30 barrels less per day for the heating of the reservoir to be significant. If it is easy to increase production by heating of 5 barrels per day from 30 to 50%, at 30 barrels per day, the injection of heat will be inefficient in practical terms except if only paraffins or asphaltenes are melted very locally, which could be carried out by momentarily slowing down production to allow the heat to penetrate the reservoir.

By way of order of magnitude, in a vertical well and for a basic production of 10 barrels per day, at least a quantity of heat of around 2 kW must be injected. The minimal thermal losses of a 1000 m long pipe with a porous insulator under reduced pressure are of between 2 and 5 kW for the required temperature difference. We see that the power to be injected upstream of the pipe must be of around twenty or so kW for the thermal losses along the injection pipe to leave the injected fluid at a sufficiently high temperature (for example 150° C.) when reaching the liner.

When the flow from the production zone is over 3 barrels per day and per meter of liner or drain, the arrival of frigories from the fluid flowing from the production zone to the liner or drain is greater than the quantity of heat transmitted by conduction by said liner or drain, thereby reducing the advantage procured by the invention in this field of productivity.

FIG. 1 shows an overall view of an installation 1 in accordance with the present invention in a well 2 to extract a liquid 3. In this embodiment, the well is vertical. So as to extract the liquid 3 present underground in a geological pocket or deposit 4, a substantially vertical bore hole 5 is made connecting the surface with the deposit 4, as the hole 5 is being drilled, which can lead to lengths of several kilometers. The bore hole 5 is consolidated by the insertion of cylindrical segment of casing 6. These segments are inserted one after the other in a known manner, the subsequent segments nesting in the previous ones. The succession of these segments constitutes the casing 6 which is substantially tubular in shape and slightly tapered downwards with an order of magnitude of 9"⅝ (245 cm). This method is quite classical and does not require further explanation.

The end of this casing 6 is provided with radial perforations 7 at its lower end in the deposit 4 and these perforations enable liquid 3 to enter into the casing 6. This part of the casing is commonly called the liner or drain 17. In this casing, a pumping pipe 8 is positioned with a space between the casing 6 and pumping pipe 8. It connects the lower end of the casing 6 at the deposit 4 where it collects the liquid 3 to raise it to the surface. This pipe 8 is extended by a surface duct 9 enabling the fluid mixture to be collected in a reservoir 10. Additional pumping may be provided continuously by a pump 11, or recovery unit, positioned for example near the reservoir 10. The diameter of the pumping pipe 8 is classically equal to 4"½ (114 cm).

Additional pipe 12 is positioned in the casing 6 to ensure the injection of a hot fluid at the bottom of the well, at the deposit 4. This pipe 12, given the available space, has an external diameter of around 2"½ (63.5 cm). This diameter must be further reduced to integrate all the mechanical and thermal protections for the pipe 12 and liquid mixture 3. This pipe 12 is extended by an external duct 13 opening out into the reservoir 10. A boiler 14 and an injection pump 15 are incorporated along the duct 13. This pump 15 extracts a fraction of the fluid mixture from the reservoir 10. Thus, there is a continuous circulation between deposit 4 and reservoir 10. A vacuum pump 16 is provided to create a partial vacuum in the ring-shaped space in the pipe 12. The boiler 14 and pumps 15 and 16 may be positioned at any other point on the pipe. In the Figure, pipe 12 is inserted into the free space between the casing 6 and the pumping pipe 8 which an extraction tubing but it may also be inserted in the pumping pipe 8.

Figure 1A:
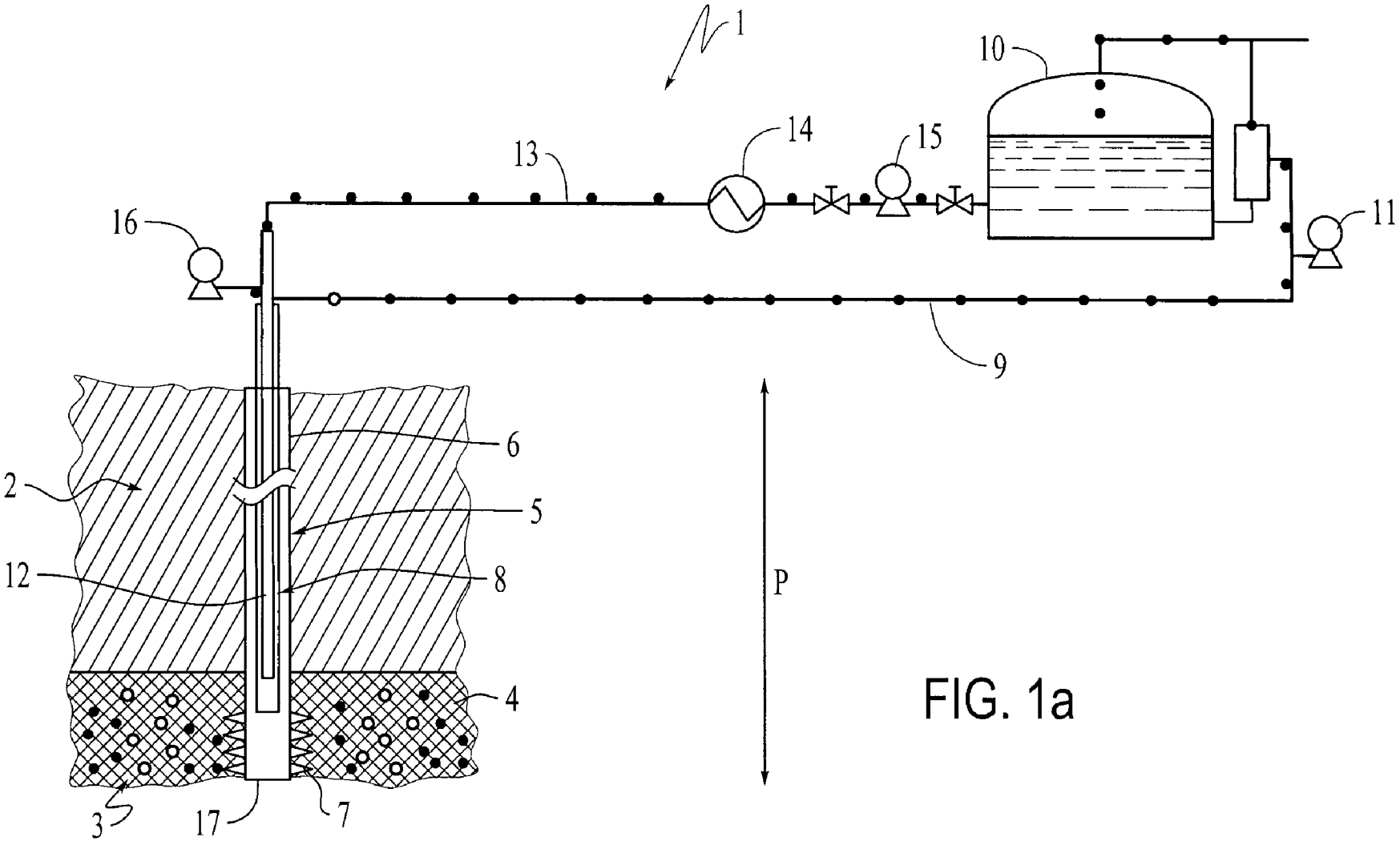
FIG. 1*a* presents another embodiment of the installation according to the invention.

FIG. 1*a* illustrates such a configuration, for example, in which pipe 12 is inserted in pumping pipe 8.

The fluid thus injected at the bottom 4 may act chemically or thermally. Its chemical activity may be as a dissolvent so as to limit, reduce or eliminate precipitations such as paraffins or asphaltenes, which precipitate around the perforations 7 in the casing 6 when they solidify, thereby blocking them. Such a solvent or dissolvent may be, for example, xylene, propane, carbon dioxide. The chemical action may also be fluidifying. A thinner will thus act by preventing thickening and precipitation, but also by fluidifying the liquid 3 at the deposit 4 near to the end of the casing 6, thereby facilitating the extraction of the liquid 3 and enabling the extraction flow to be increased. The injection of such a solvent or thinner may advantageously be effected after increase in its temperature and/or pressure.

The fact of using a hot fluid induces a double action. The heat allows the fractions already solidified or precipitated to be melted. Moreover, the heat causes a reduction in the viscosity of the liquid 3 to be extracted. This becomes more fluid when warmed. Through conduction in the reservoir rock, the heat injected will fluidify the hydrocarbons to be extracted and thus reduce the loss of head. Thus, for a same pumping power, a greater quantity of liquid will be extracted (improvement in productivity) and liquid imprisoned deeper in the reservoir may be pumped (improvement in recoverable reserves). Thus, so as not to pollute the deposit by the introduction of an exogenous fluid, it is advantageous, after heating, to use the mixture of hydrocarbons having just been extracted by way of a hot fluid. It is thus possible for part of the liquid 3 extracted by the pumping pipe 12 to be removed for heating in the boiler 14 and then re-injected whilst hot into the pipe 12. This liquid 3 is a good heat conductor. Moreover, since there is no risk of polluting the production zone by an exogenous product, it is possible for large quantities and thus great quantities of heat to be injected.

Since the depth (p) of the bore hole may reach several hundred meters (100 to 2000 m), it is essential in order for heat to be injected at the bottom 4 to have highly thermally insulated pipe 12. Advantageously, the fluid is heated in pipe 12 using an electrical conductor.

Figure 2:
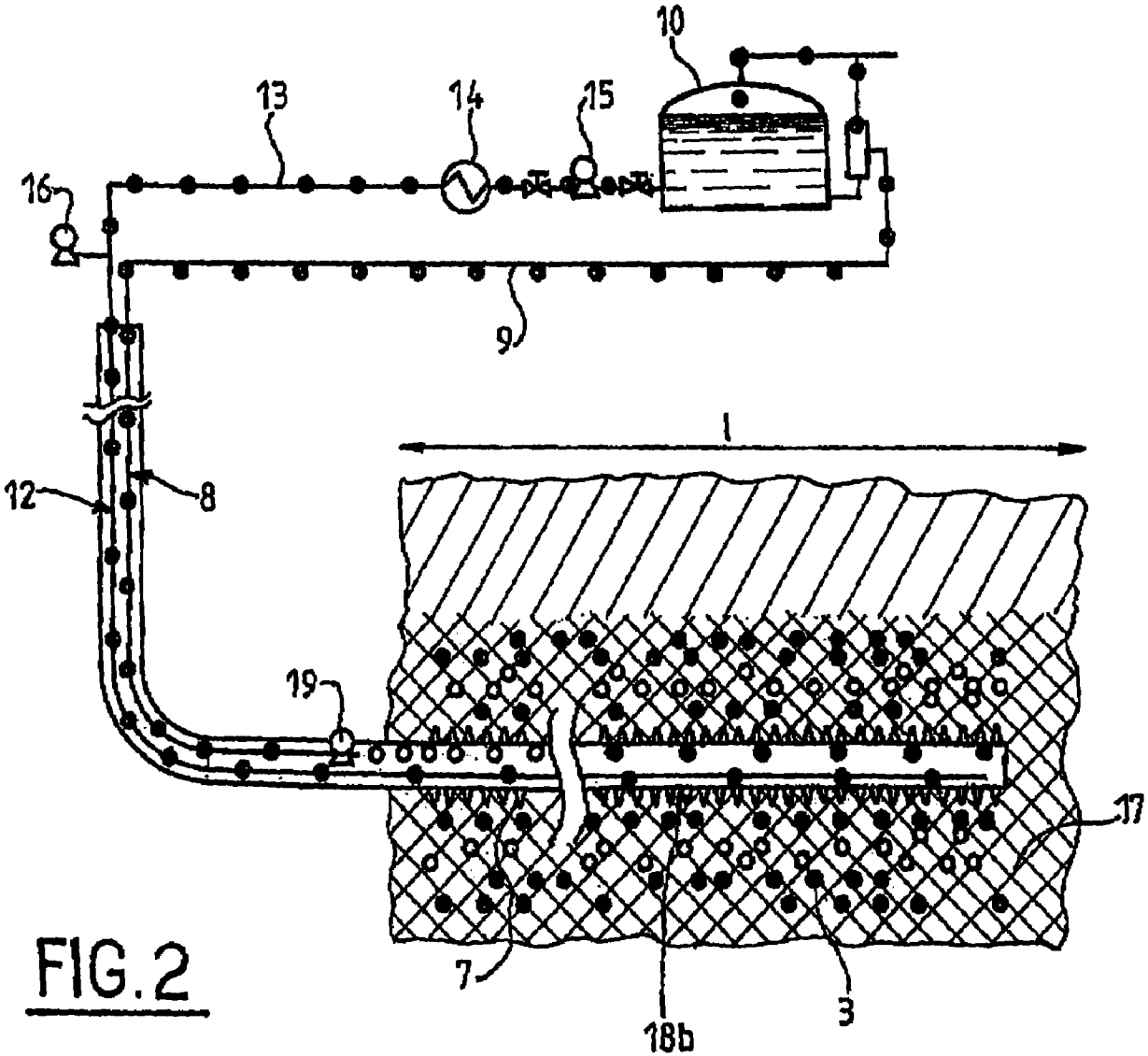
FIG. 2 presents another embodiment of the installation.

FIG. 2 shows another extraction installation 1 for a horizontal deposit 4 in which the casing 6 is extended by a substantially horizontal drain 17 of a length (l) of around 500 to 2,000 meters. In this embodiment, the end of the pumping pipe 8 by which the extractable fluid enters can be seen positioned near the mouth of the drain 17 and fitted with a pump 18. This pump is classically either a pumping unit with a surface mechanism and a suction part at the end of pipe 8, or a MOINEAU or PCP pump whose body is located at the end of pipe 8. On the contrary, pipe 12 extends over the full length of drain 17 so as to ensure the circulation of hot fluid constituted by hydrocarbons over the full length of the liner 17. It can be observed that the production zone has a low flow of 0.2 to 2 barrels per day and per meter. But the long length of the horizontal drain 17 enables substantial absolute flows of around 500 to 3,000 barrels per day. In these conditions, an injection of heat at the drain is most advantageous. The hot fluid will mix with the oil produced to be heated as well as the liner and will thus reduce the viscosity in the drain and in the reservoir, thereby reducing the loss of head and facilitating the extraction of the hydrocarbons. Indeed, with the same pumping power it is possible for the liquid imprisoned in the rock to be extracted more quickly (improvement in productivity) and for hydrocarbons to be extracted from deeper in the reservoir (increase in recoverable reserves).

Figure 3:
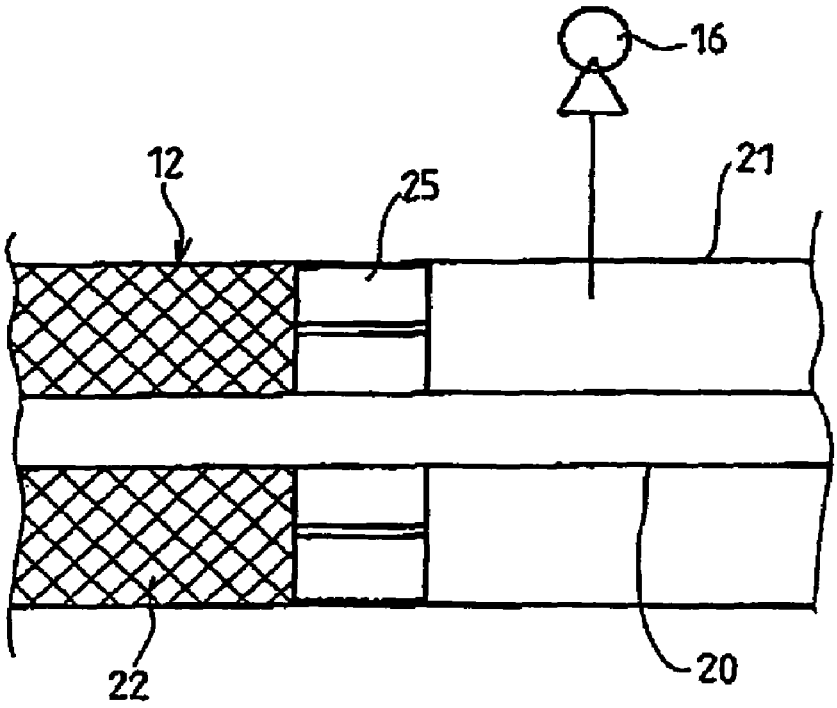
FIG. 3 is a section of one embodiment of pipe.

FIG. 3 shows a cross section of pipe 12 particularly suited to the installations as represented in FIGS. 1 and 2. Pipe 12 is produced using the technique known as "pipe in pipe". A first inner pipe 20 ensures the transport of the fluid. This first pipe 20 is mechanically protected by a second external pipe 21 of a greater diameter concentric to the first pipe 20. Between the two pipes there is insulator 22.

Several possibilities exist to provide insulation between the two pipes 20 and 21.

A vacuum is a very good insulator. Given the great lengths of pipe 12 in question, compression stresses in the annular space between these pipes and the thermal variations will cause buckling stress in pipes 20 and 21, such a solution is not able to ensure that these two pipes will not come into contact with one another. Such contact would firstly eliminate the insulating vacuum between the two pipes and would also lead by conduction to substantial thermal losses, more so because the pipes are made of metallic material. These contacts may be avoided by introducing spacers 25 between the two pipes.

It is thus preferable for a rigid insulator 22 to be introduced into the space between pipes 20 and 21 able to withstand crushing and which will act as a spacer to prevent pipes 20 and 21 from coming into contact. The material used to produce these spacers must have good insulating properties. Such a material may advantageously be a microporous material. This microporous material, of the type described in patent FR-2746891, is advantageously obtained by compressing a powder, for example pyrogenated silica. Such a compressed microporous material advantageously has a density of between 200 and 400 kg/m$^3$. The thermal insulating capacities of such a material are considerably improved when it is placed at low pressure in the annular space between the two pipes. Such low pressure, advantageously between 1 mbar and the atmospheric pressure, may be obtained here by using a vacuum pump between pipes 20 and 21. The objective conditions are considerably less demanding that for the vacuum proposed previously using the pump 16. The spacer function fulfilled by such a microporous material may be obtained if it is used to totally fill the space between the two pipes. From a mechanical point of view, it is also possible to position spacers 25 made of this microporous material which are only a few centimeters in length evenly along pipe 12, at intervals of 0.1 and 1 meter, thereby ensuring reinforcement against any crushing of the insulator.

Figure 4:
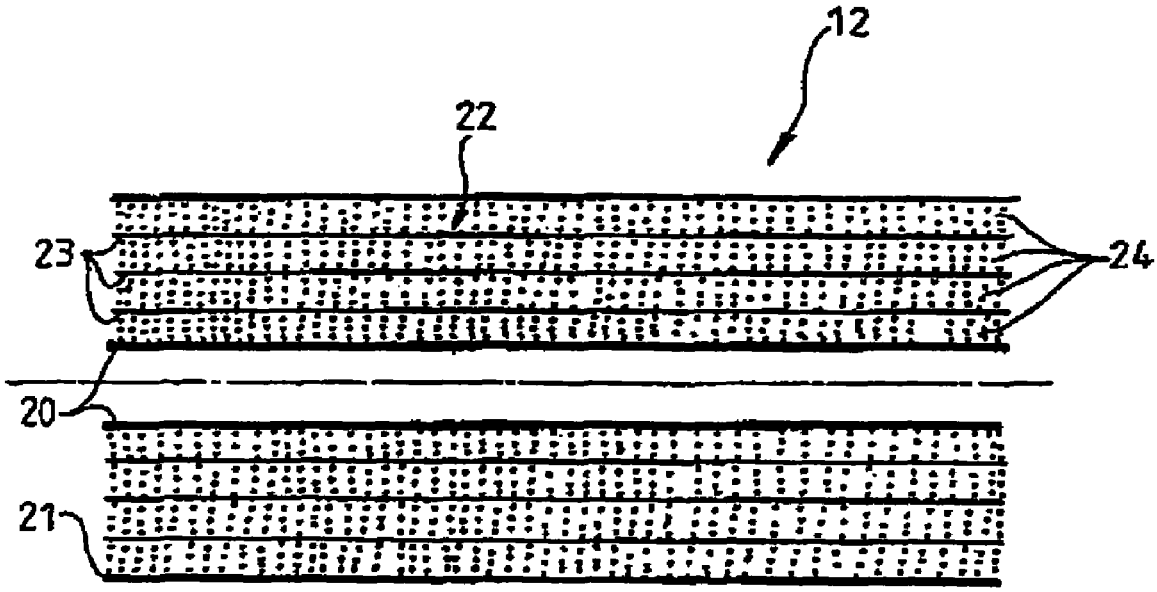
FIG. 4 is a section of another embodiment of pipe.

An insulator 22 may also be made by producing a multilayer superinsulator constituted by reflective screen sheets 23 sandwiching layers of powder 24 such as that described in patent FR-2862122 and shown in FIG. 4. The screens are constituted by a reflective sheet, for example aluminum, onto which the powder is deposited, wound in a spiral around itself. The powder 24 has a granulometry substantially equal to 40 μm, pores whose size is of the order of magnitude of the mean free path of the gas molecules in which this powder is placed and a density of between 50 and 150 kg/m$^3$.

Advantageously, pressure of between $10^{-2}$ and 1 mbar is maintained between the two pipes of the pipe.

It is also possible for an insulator 22 to be made by combining the use of multilayered reflective screen sheets 23 with a partial vacuum of around $10^{-2}$ to 1 mbar. Such an insulator enables the production zone to be heated to a temperature close to 200° C. enabling the viscosity of the hydrocarbons to be considerably reduced and thus ensuring pumping in acceptable economic conditions.

Pipe such as that described above provides an injection of heat that is enough to make the hydrocarbons sufficiently fluid using a boiler at 20 to 5000 KW.

The installation 1 according to the invention allows the production of crude oil to be increased by 20 to 100%, abandoned reserves to be exploited and any pollution of the deposits to be avoided.

By way of illustration, a double pipe according to the invention may be constituted by an external pipe with an external diameter of 33 mm and a thickness of 2 mm and an internal pipe with an external diameter of 13 mm and a thickness of 2 mm able to transport 20 kW at 200° C. for an overall distance of 1,000 meters. A double pipe 12 constituted by an external pipe with an external diameter of 60 mm and a thickness of 6 mm and an internal pipe with an external diameter of 33 mm and a thickness of 4 mm will easily be able to transport 200 kW at 200° C. for an overall distance of 2,000 meters.

What is claimed is:

1. A hydrocarbon extraction process enabling an acceleration in the production of the productive zone of the oil deposit of a well and an increase in the cumulated quantity of hydrocarbons, wherein a hot fluid comprising liquid hydrocarbons is made to circulate so as to bring said productive zone locally to a higher temperature by conduction in order to fluidify the hydrocarbons imprisoned in an underground reservoir, by means of a thermally-insulated pipe, said hot fluid being mixed with the hydrocarbons extracted via a liner or drain in said productive zone such mixture thus formed being recovered at the surface by means of a pumping pipe;

wherein the production is such that the arrival of frigories via the hydrocarbons extracted from said reservoir is less than the quantity of heat diffused mostly by conduction in the reservoir and whose flow is maintained at less than 3 barrels per day and per linear meter of drain or liner.

2. A hydrocarbon extraction installation using a bore hole linking the surface to an oil deposit, comprising:

a substantially cylindrical casing consolidating said bore hole and a pumping pipe housed inside said casing, said casing being extended by a liner or drain, a boiler to produce hot fluid constituted by hydrocarbons, a thermally insulated pipe connecting said boiler to said oil deposit enabling hot fluid to circulate from the surface to said liner to obtain a fluid mixture constituted by the hot fluid and hydrocarbons coming from said oil deposit, wherein:

said thermally insulated pipe is inserted in a space available between said casing and said pumping pipe, and said thermally insulated pipe is constituted by a first inner pipe surrounded by a second external concentric pipe and an insulator housed in the space between said first and second inner pipes; and a recovery unit for the fluid mixture by means of said pumping pipe.

3. An extraction installation according to claim 2, wherein said hot fluid is a dissolvent for paraffins and/or asphaltenes or a fluidizer for hydrocarbons or a mixture of dissolvent/hydrocarbons.

4. An extraction installation according to claim 2, wherein said hot fluid is the mixture of extracted and heated fluid.

5. An extraction installation according to claim 2, wherein said insulator is a pulverulent material and a reduced pressure is established in the space between said first and second inner pipes.

6. An extraction installation according to claim 5, wherein said hot fluid is a dissolvent for paraffins and/or asphaltenes or a fluidizer for hydrocarbons or a mixture of dissolvent/hydrocarbons.

7. An extraction installation according to claim 5, wherein said hot fluid is the mixture of extracted and heated fluid.

8. An extraction installation according to claim 2, wherein said insulator is constituted of a reflective sheet onto which a powder has been deposited, said reflective sheet being wound around itself in a spiral.

9. An extraction installation according to claim 8, wherein said hot fluid is a dissolvent for paraffins and/or asphaltenes or a fluidizer for hydrocarbons or a mixture of dissolvent/hydrocarbons.

10. An extraction installation according to claim 8, wherein said hot fluid is the mixture of extracted and heated fluid.

11. An extraction installation according to claim 8, wherein said powder has a granulometry substantially equal to 40 mm, pores whose size is around that of the mean free path of the gas in which it is placed and a density of between 50 and 150 kg/m$^3$.

12. An extraction installation according to claim 11, wherein a pressure of between $10^{-2}$ and 1 mbar is maintained between said first and second inner pipes.

13. An extraction installation according to claim 12, wherein said hot fluid is a dissolvent for paraffins and/or asphaltenes or a fluidizer for hydrocarbons or a mixture of dissolvent/hydrocarbons.

14. An extraction installation according to claim 12, wherein said hot fluid is the mixture of extracted and heated fluid.

15. An extraction installation according to claim 11, wherein said hot fluid is a dissolvent for paraffins and/or asphaltenes or a fluidizer for hydrocarbons or a mixture of dissolvent/hydrocarbons.

16. An extraction installation according to claim 11, wherein said hot fluid is the mixture of extracted and heated fluid.

17. An extraction installation according to claim 2, wherein said thermally insulated pipe comprises spacers between said first and second inner pipes, the spacers comprising a compressed microporous material placed at regular intervals along said thermally insulated pipe and providing reinforcement and preventing said insulator from being crushed.

18. An extraction installation according to claim 17, wherein said hot fluid is a dissolvent for paraffins and/or asphaltenes or a fluidizer for hydrocarbons or a mixture of dissolvent/hydrocarbons.

19. An extraction installation according to claim 17, wherein said hot fluid is the mixture of extracted and heated fluid.

20. A hydrocarbon extraction process enabling an acceleration in the production of the productive zone of the oil deposit of a well and an increase in the cumulated quantity of hydrocarbons, wherein a hot fluid constituted of hydrocarbons is made to circulate within a liner or drain, and maintained substantially within the liner or drain, so as to bring said productive zone locally to a higher temperature by conduction in order to fluidify the hydrocarbons imprisoned in an underground reservoir, by means of a thermally-insulated pipe, said hot fluid being mixed with the hydrocarbons within the liner or drain in said productive zone such mixture thus formed being recovered at the surface by means of a pumping pipe.

21. The hydrocarbon extraction process according to claim 20, wherein the hydrocarbons are circulated by a process not including steam injection.

22. The hydrocarbon extraction process according to claim 20, wherein the hot fluid constituted of hydrocarbons comprises previously recovered fluid.

23. The hydrocarbon extraction process according to claim 20, wherein the hot fluid constituted of hydrocarbons comprises fluid previously recovered at the surface by means of the pumping pipe.

24. A hydrocarbon extraction installation using a bore hole linking the surface to an oil deposit, comprising:

a substantially cylindrical casing consolidating said bore hole and a pumping pipe housed inside said casing, said casing being extended by a liner or drain, a boiler to produce hot fluid constituted by hydrocarbons, a thermally insulated pipe connecting said boiler to said oil deposit enabling hot fluid to circulate from the surface to said liner to obtain a fluid mixture constituted by the hot fluid and hydrocarbons coming from said oil deposit, wherein:

said thermally insulated pipe is inserted in said pumping pipe, and said thermally insulated pipe is constituted by a first inner pipe surrounded by a second external concentric pipe and an insulator housed in the space between said first and second inner pipes; and a recovery unit for the fluid mixture by means of said pumping pipe.

25. An extraction installation according to claim 24, wherein said hot fluid is a dissolvent for paraffins and/or asphaltenes or a fluidizer for hydrocarbons or a mixture of dissolvent/hydrocarbons.

26. An extraction installation according to claim 24, wherein said hot fluid is the mixture of extracted and heated fluid.

27. An extraction installation according to claim 24, wherein said insulator is a pulverulent material and a reduced pressure is established in the space between said first and second inner pipes.

28. An extraction installation according to claim 27, wherein said hot fluid is a dissolvent for paraffins and/or asphaltenes or a fluidizer for hydrocarbons or a mixture of dissolvent/hydrocarbons.

29. An extraction installation according to claim 27, wherein said hot fluid is the mixture of extracted and heated fluid.

30. An extraction installation according to claim 24, wherein said insulator is constituted of a reflective sheet onto which a powder has been deposited, said reflective sheet being wound around itself in a spiral.

31. An extraction installation according to claim 30, wherein said powder has a granulometry substantially equal to 40 mm, pores whose size is around that of the mean free path of the gas in which it is placed and a density of between 50 and 150 kg/m$^3$.

32. An extraction installation according to claim 31, wherein a pressure of between $10^{-2}$ and 1 mbar is maintained between said first and second inner pipes.

33. An extraction installation according to claim 32, wherein said hot fluid is a dissolvent for paraffins and/or asphaltenes or a fluidizer for hydrocarbons or a mixture of dissolvent/hydrocarbons.

34. An extraction installation according to claim 32, wherein said hot fluid is the mixture of extracted and heated fluid.

35. An extraction installation according to claim 31, wherein said hot fluid is a dissolvent for paraffins and/or asphaltenes or a fluidizer for hydrocarbons or a mixture of dissolvent/hydrocarbons.

36. An extraction installation according to claim 31, wherein said hot fluid is the mixture of extracted and heated fluid.

37. An extraction installation according to claim 30, wherein said hot fluid is a dissolvent for paraffins and/or asphaltenes or a fluidizer for hydrocarbons or a mixture of dissolvent/hydrocarbons.

38. An extraction installation according to claim 30, wherein said hot fluid is the mixture of extracted and heated fluid.

39. An extraction installation according to claim 24, wherein said thermally insulated pipe comprises spacers between said first and second inner pipes, the spacers comprising a compressed microporous material placed at regular intervals along said thermally insulated pipe and providing reinforcement and preventing said insulator from being crushed.

40. An extraction installation according to claim 39, wherein said hot fluid is a dissolvent for paraffins and/or asphaltenes or a fluidizer for hydrocarbons or a mixture of dissolvent/hydrocarbons.

41. An extraction installation according to claim 39, wherein said hot fluid is the mixture of extracted and heated fluid.

* * * * *